US005711621A

United States Patent [19]

Austin

[11] Patent Number: 5,711,621

[45] Date of Patent: Jan. 27, 1998

[54] METHOD AND APPARATUS FOR SELECTING PRINTER PARAMETERS FOR DIFFERENT TYPES OF PRINT MEDIA

[75] Inventor: Pixie A. Austin, Marysville, Wash.

[73] Assignee: Intermec Corporation, Everett, Wash.

[21] Appl. No.: 732,059

[22] Filed: Oct. 16, 1996

[51] Int. Cl.[6] ..... B41J 2/36

[52] U.S. Cl. ..... 400/120.13; 347/193; 400/74

[58] Field of Search ..... 400/103, 120.13, 400/70, 74, 76, 61, 62; 347/193

[56] References Cited

U.S. PATENT DOCUMENTS

| | | | |
|---|---|---|---|
| 4,558,963 | 12/1985 | Applegate et al. . | |
| 4,657,418 | 4/1987 | Lahr . | |
| 4,812,063 | 3/1989 | Kunimitsu et al. . | |
| 4,860,025 | 8/1989 | Berson et al. . | |
| 4,878,773 | 11/1989 | Mazumder . | |
| 4,919,555 | 4/1990 | Kikuchi . | |
| 4,934,847 | 6/1990 | Shiozaki et al. . | |
| 4,949,098 | 8/1990 | Gluck et al. . | |
| 4,953,994 | 9/1990 | Shiozaki et al. . | |
| 4,973,985 | 11/1990 | Genno et al. . | |
| 4,974,977 | 12/1990 | Morgan et al. . | |
| 4,982,202 | 1/1991 | Buan et al. . | |
| 5,032,032 | 7/1991 | Chu et al. . | |
| 5,040,461 | 8/1991 | Van-Ocker . | |
| 5,061,946 | 10/1991 | Helmbold et al. . | |
| 5,122,882 | 6/1992 | Ishida et al. . | |
| 5,274,395 | 12/1993 | Mizoguchi et al. | 400/120.13 |
| 5,322,380 | 6/1994 | Crocker . | |
| 5,335,837 | 8/1994 | Saeki et al. . | |
| 5,372,439 | 12/1994 | Poole et al. . | |
| 5,492,423 | 2/1996 | Smith . | |
| 5,564,841 | 10/1996 | Austin et al. | 400/103 |

FOREIGN PATENT DOCUMENTS

| | | |
|---|---|---|
| 0294792 A1 | 12/1988 | European Pat. Off. . |
| 0500008 A2 | 8/1992 | European Pat. Off. . |
| 55-32603 | 3/1980 | Japan . |
| 58-201686 | 11/1983 | Japan . |
| 60-18362 | 1/1985 | Japan . |
| 60-187570 | 9/1985 | Japan . |
| 61-116568 | 6/1986 | Japan . |
| 61-135773 | 6/1986 | Japan . |
| 62-181168 | 8/1987 | Japan . |
| 63-237970 | 10/1988 | Japan . |
| 2-305666 | 12/1990 | Japan . |
| 3-178457 | 8/1991 | Japan . |

*Primary Examiner*—John S. Hilten
*Attorney, Agent, or Firm*—Graham & James LLP

[57] ABSTRACT

A thermal printer is provided which can be easily calibrated by an operator for any selected type of print media. The thermal printer includes a thermal print head and a rotatable platen adapted to draw a print media therebetween. The thermal print head is adapted to selectively activate portions of the print media. To calibrate the printer in order to optimize printer performance for print quality, an operator first identifies a type of print media which is selected for use on the printer. The printer will then print a series of test labels onto the selected type of print media using a parameter of the printer having a unique value for each individual one of the test labels of the series. Identifying information of the unique parameter value is also printed onto each respective test label. By inspecting the series of test labels, the operator can select one of the test labels having a desired level of image quality. The operator then specifies the unique parameter value of the selected one of the test labels for further operation of the printer with the selected type of print media.

20 Claims, 2 Drawing Sheets

METHOD AND APPARATUS FOR SELECTING PRINTER PARAMETERS FOR DIFFERENT TYPES OF PRINT MEDIA

BACKGROUND OF THE INVENTION

1. Field of the Invention

The present invention relates to thermal printing, and more particularly, to a method and apparatus that enables an operator of a thermal printer to easily select operating parameters for the printer for use with different types of print media.

2. Description of Related Art

In the field of bar code symbology, parallel bars of varying thicknesses and spacing are used to convey information, such as an identification of the object to which the bar code is affixed. To read the bar code, the bars and spaces are scanned by a moving light source, such as a laser, or imaged by an optically imaging element, such as a charge coupled device. Since the bars and spaces have differing light reflective characteristics, the information contained in the bar code can be read by interpreting the light that reflects from the bar code, or the image pattern that contains the bar code.

Bar codes are often printed onto a print media that can be associated with or affixed to the objects intended to be identified. The print media typically comprises a paper face material onto which the bar code is printed and an adhesive backing layer applied to an opposite surface of the face material that permits it to be affixed to an object. The face material may be further separated into discrete labels that are laminated onto a release liner having a low-stick surface that allows the labels to be removed easily. After the information is printed onto the face material, the user can simply peel off the individual labels from the release liner, and apply the labels onto an object of interest. Alternatively, the print media may include a non-adhesive card or tag stock which is similar to the paper face material, but may be thicker and stiffer, and may not have an adhesive layer or release liner attached. Such print media may include perforation lines to separate individual tags or cards following printing of information thereon.

In order to accurately read the bar code, it is thus essential that the bar code be printed in a high quality manner, without any streaking or blurring of the bar code. Moreover, it is essential that the adhesive backing layer of the print media not be damaged by heat generated during the printing process, otherwise the media will not stick properly to the object. In view of these demanding printing requirements, bar codes are often printed using direct thermal or thermal transfer printing techniques. In direct thermal printing, the face material of the print media is impregnated with a thermally sensitive chemical that is reactive upon exposure to heat for a period of time. In thermal transfer printing, an ink ribbon is impregnated with the thermally sensitive chemical, and is transported cooperatively with the print media. Direct thermal printing has certain advantages since it avoids the need for the ink ribbon; however, the direct thermal media will continue to react following printing upon exposure to ultraviolet light, and is thus not usable in certain applications. Accordingly, an operator of a printer may select between direct thermal or thermal transfer print media depending upon a particular end use for the printed information. Direct thermal and thermal transfer printing techniques are referred to collectively herein as thermal printing.

To print the bar code symbols using thermal printing, the print media is drawn past a thermal print head having linearly disposed printing elements that extend across a width of the print media. The printing elements are selectively activated in accordance with instructions from a controller to heat localized areas of the face material, thereby creating a dark image by a chemical reaction brought on by the heat. As the print media (and ink ribbon for thermal transfer printing) is drawn through a print region between a platen and the thermal print head, the bar code is printed onto the face material. Other images, such as text, graphics or special characters, can also be printed in the same manner.

There are three fundamental parameters that determine the image quality of a thermal printer, including sensitivity, darkness and print speed. The sensitivity parameter relates to the temperature setting for the printing elements of the thermal print head. The darkness parameter relates to the amount of time that the printing elements are activated or an increased amount of energy for the same time. The print speed relates to the rate that the print media is drawn past the thermal print head. Since every type of print media has unique characteristics, e.g., the thickness of the face material, the concentration of the thermally sensitive chemical impregnation, the transport resistance of the print media material, etc., the printer parameters should be calibrated for the particular type of print media that is selected. Ordinarily, a printer manufacturer will specify certain types of print media for a printer, and will include a listing of the recommended parameter values to obtain acceptable image quality with a specified type of print media.

Notwithstanding the clear advantages of using a specified type of print media, there are several reasons why an operator of a printer may opt to use a type of print media that is not specified by the manufacturer. First, the specified print media may not be available. Second, the non-specified print media may be less expensive than a comparable specified print media. Third, the non-specified print media may have other desirable attributes that are not obtainable in the specified print media, such as ultraviolet resistance, special top coats or a unique pre-printed image, etc. Once a non-specified print media is selected, the printer operator must experiment with the printer parameter values until a combination is obtained that provides acceptable image quality; however, such experimentation can be unduly time consuming, wasteful of print media and frustrating for the printer operator. If acceptable image quality cannot be readily achieved, the operator will often blame the printer rather than the print media for the problem.

Thus, it would be desirable to provide a simple method for a printer operator using a non-specified type of print media to calibrate the thermal printer parameters in order to obtain acceptable image quality.

SUMMARY OF THE INVENTION

In accordance with the teachings of the present invention, a thermal printer is provided which can be easily calibrated by an operator for any selected type of print media.

More particularly, the thermal printer includes a thermal print head and a rotatable platen adapted to draw a print media therebetween. The thermal print head under processor control is adapted to selectively activate portions of the print media. To calibrate the printer, an operator first identifies a type of print media which is selected for use on the printer. The printer executes a test program to print a series of user-selectable test labels onto the selected type of print media using a parameter of the printer having a unique value for each individual one of the test labels of the series.

Identifying information of the unique parameter value is also printed onto each respective test label. By inspecting the series of test labels, the operator can select one of the test labels having a desired level of image quality. A bar code verifier may be used to help the operator determine which test label has an energy level the meets the desired print quality. The operator then specifies the unique parameter value of the selected one of the test labels for further operation of the printer with the selected type of print media.

A more complete understanding of the method and apparatus for selecting printer parameters for different types of print media will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

The present invention satisfies the need for a simple method for a printer operator using a non-specified type of print media to select the thermal printer parameters in order to obtain acceptable image quality. In the detailed description that follows, like element numerals are used to describe like elements illustrated in one or more of the figures.

Figure 1:
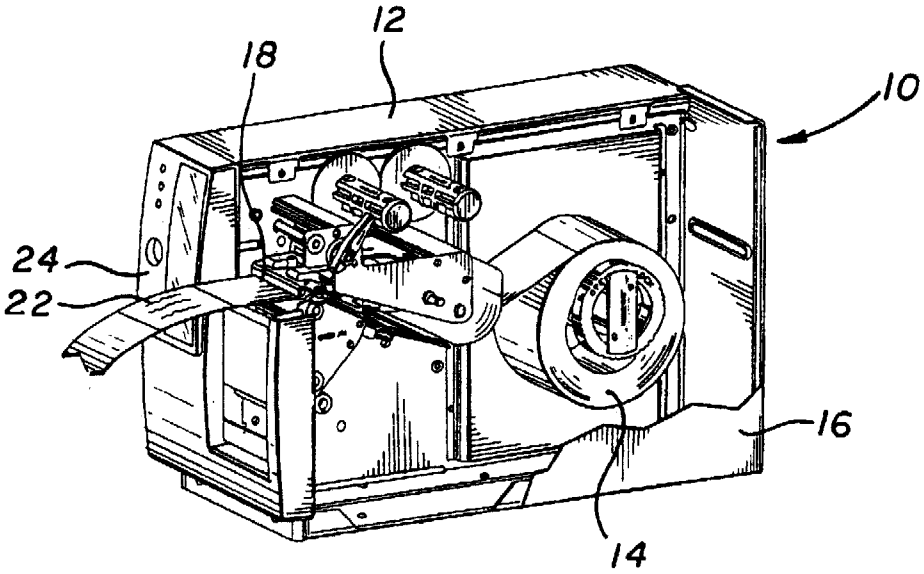
FIG. 1 is a perspective view of an exemplary thermal printer.

Referring first to FIG. 1, a thermal printer 10 of the present invention is disclosed. The printer 10 comprises a housing 12 which encloses the operative elements of the printer, such as a transport mechanism that will transport print media to a thermal print head. As known in the art, the transport mechanism may further include a platen driven by a motor to draw a web of the print media past the thermal print head. It should be understood that these conventional elements of a printer otherwise not pertinent to the discussion of the present invention are omitted for simplicity, but would necessarily be included in an actual printer.

The printer 10 includes a removable cover 16 that provides access through a portion of the housing 12 to a media supply region in which a media supply roll 14 is operatively disposed. The cover 16 prevents dust, moisture or other contaminants from entering the printer housing 12. An operator of the printer 10 would load a new media supply roll 14 into the printer after removing the cover 16, and conversely, would remove an empty core of a media supply roll once the supply roll is spent. A web of the print media is paid out from the media supply roll 14 to the print head of the printer 10 by operation of the transport mechanism, and printed media 22 thus exits the printer housing 12 via a media exit opening 18 disposed at a front portion of the printer. As noted above, direct thermal printing operations require that the print media be impregnated with a thermally sensitive chemical. For thermal transfer printing operations, an ink ribbon (not shown) is utilized which is transported cooperatively past the print head along with the print media. Accordingly, the printer 10 of the present invention may be configured for either direct thermal or thermal transfer printing operations by selection of the appropriate type of print media.

A control panel 24 is disposed at a front surface of the printer housing 12, and has a plurality of buttons that control various operations of the printer. For example, the buttons may include a start/stop button that initiates/terminates printing operations, a reset button that clears the internal memory of the printer, and a test button that initiates a test procedure of the printer. It is anticipated that the printer 10 be connected electronically to a computer or network of computers that provides printing commands to the printer. This way, an operator of the printer 10 may send a data file from a computer to the printer to be executed by printing a series of labels. The operator may also send control information to the printer in the same manner, such as the three control parameters of sensitivity, darkness and print speed which were described previously. Alternatively, the control parameters may be provided manually to the printer 10 through switches, buttons or potentiometers disposed either on the control panel 24 or elsewhere on the printer itself.

Figure 2:
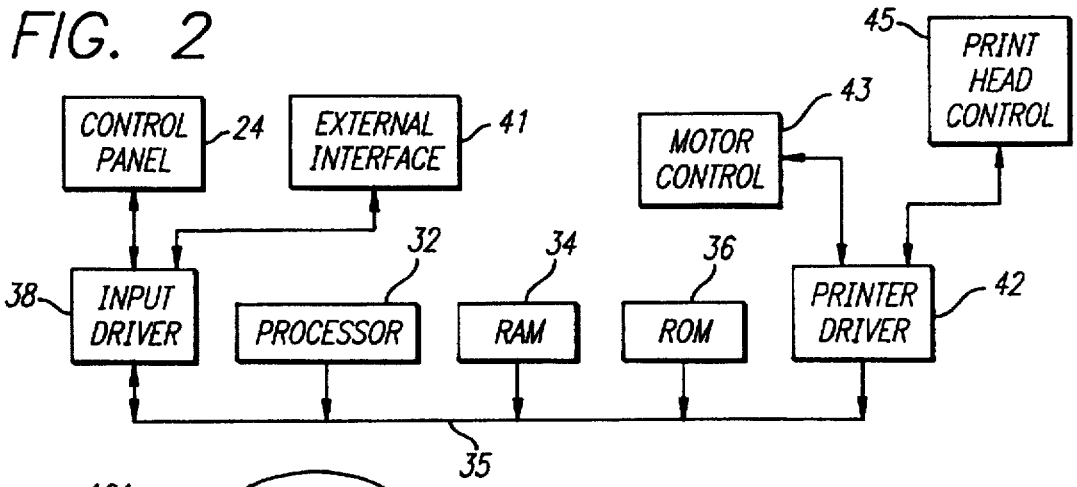
FIG. 2 is a functional block diagram of the thermal printer.

FIG. 2 is a functional block diagram of the thermal printer 10. The printer 10 includes a processor 32, a random access memory (RAM) 34, a read only memory (ROM) 36, an input/output (I/O) driver 38 and a printer driver 42. Each of the functional elements of the printer 10 are coupled together by a bi-directional data and control bus 35, over which data and control messages are transmitted. The processor 32 controls the operation of the printer 10, and may be provided by a conventional microprocessor or digital signal processor circuit. The RAM 34 provides temporary data storage for operation of the processor 32, and the ROM 36 provides for non-volatile storage of an instruction set, i.e., software, that is executed in a sequential manner by the processor to control the overall operation of the printer 10.

The I/O driver 38 manages the flow of information to and from the processor 32, and receives data and control information that is entered into the control panel 24 and through an external interface 41 that may be electrically coupled to a computer or computer network. The printer driver 38 manages the mechanical control over the printer 10, and is coupled to a motor control unit 43 and a print head control unit 45. The motor control unit 43 provides signals to the various motors of the transport mechanism that effect the transport of the print media through the printer 10. The print head control unit 45 provides signals to the thermal print head to control aspects such as activation timing, duration and temperature of the individual printing elements. The I/O driver 38 and the printer driver 42 may be provided by special function electronic devices, such as an application specific integrated circuit (ASIC), that is accessed by the processor 32 through the data and control bus 35.

As noted above, the three fundamental parameters of sensitivity, darkness and print speed determine the image quality of a thermal printer. The processor 32 uses these parameters in generating control signals to the printer driver 42, which are then used in controlling the motor control unit 43 and the print head control unit 45. The sensitivity parameter is used by the printer driver 42 to control the amplitude of activation current applied by the print head control unit 45 to the printing elements of the thermal print head. The darkness parameter is used by the printer driver 42 to control the duration of activation current applied by the print head control unit 45 to the printing elements of the thermal print head. The print speed parameter is used by the printer driver unit 42 in defining the rate at which the print media is transported under the control of the motor control unit 43. It should be apparent that variations in any one of the three parameters may adversely affect the other two parameters, and therefore, a proper balance must be achieved between the three parameters in order to obtain optimal image quality.

Figure 4:
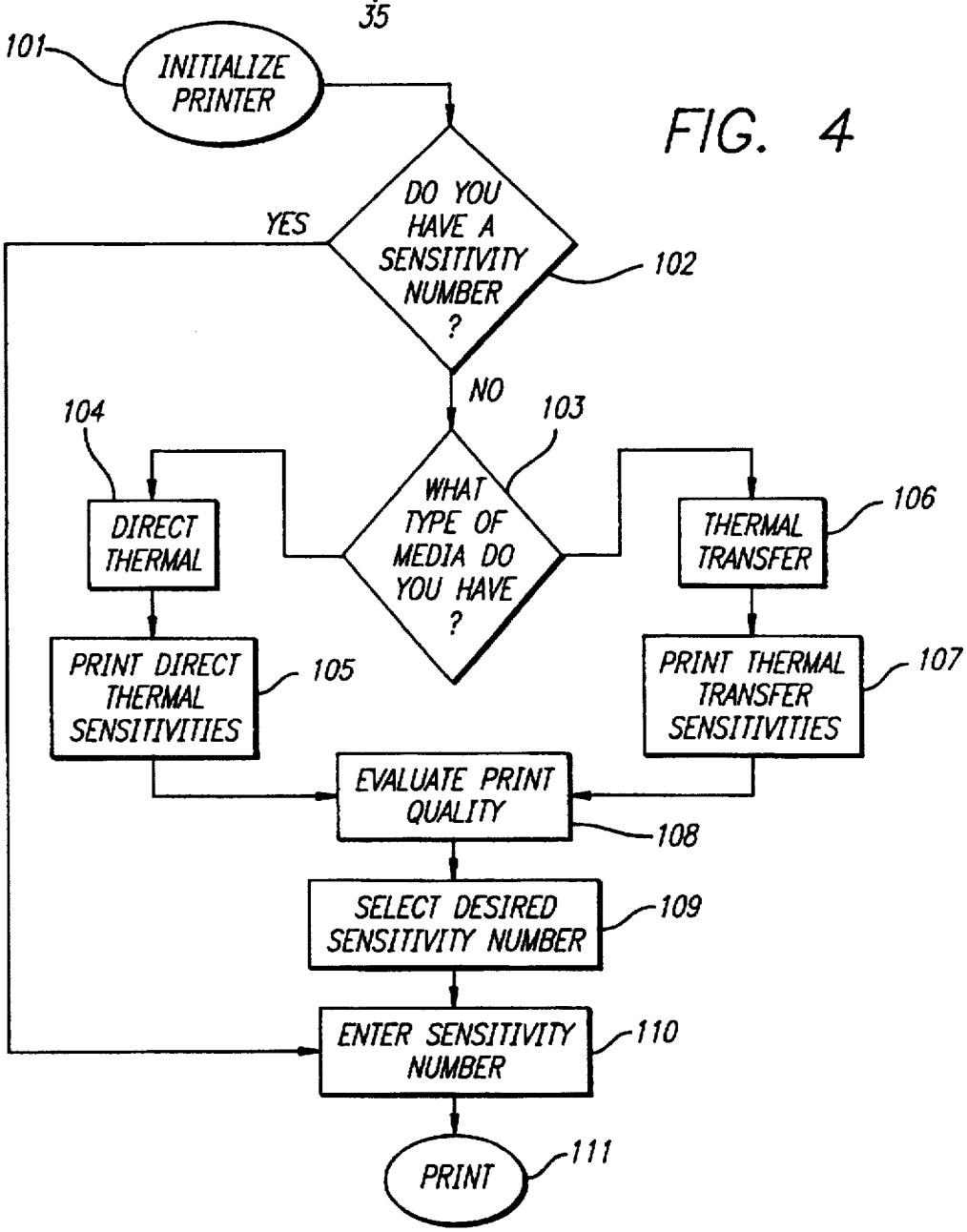
FIG. 4 is a flow chart depicting a method for selecting printer parameters.

Referring now to FIG. 4, a method for selecting optimum printer parameters is illustrated. At step 101, an operator of the printer 10 initializes the printer either through the control panel 24 or through a computer coupled to the printer. The operator will be asked at step 102 whether there is a specified sensitivity number for a particular print media. If there is a specified sensitivity number, the operator simply enters the number at step 110 and printing operations begin at step 111. On the other hand, if the sensitivity number is unknown, then the operator is asked at step 103 to identify which type of media will be used.

Specifically, the operator may choose between direct thermal media at step 104 or thermal transfer media at step 106. If the operator chooses direct thermal media, the printer 10 will then commence printing a series of labels 50*a–d* having incrementally increasing sensitivity levels, with darkness and print speed parameter values consistent with direct thermal printing operations. Similarly, if the operator chooses thermal transfer media, the printer 10 will commence printing a series of labels 50*a–d* having incrementally increasing sensitivity levels, with darkness and print speed parameter values consistent with thermal transfer printing operations. It should be apparent that, in the alternative, the darkness or print speed parameters in the series of labels may be incrementally varied rather than sensitivity parameter.

Figure 3:
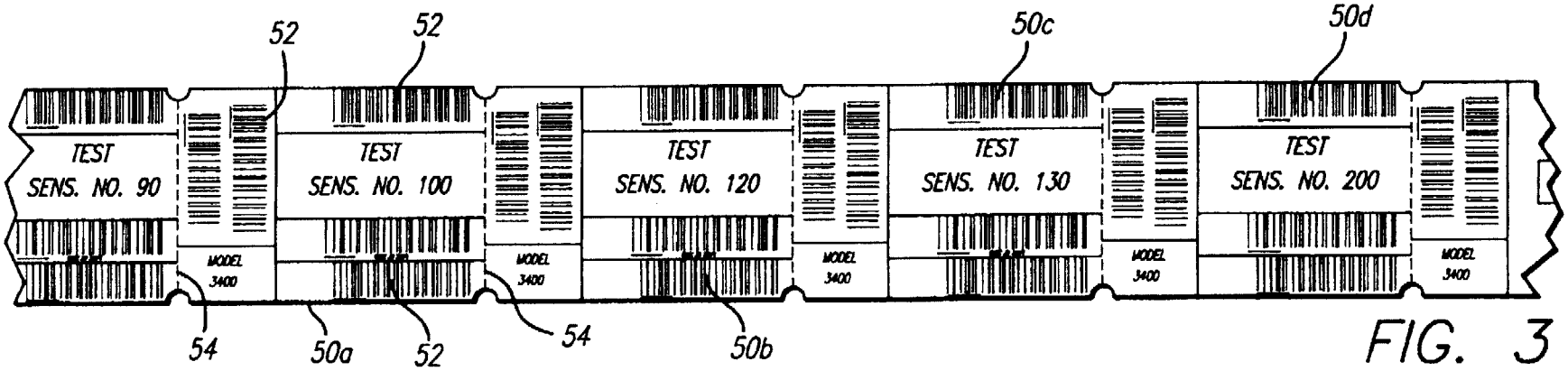
FIG. 3 illustrates a series of test labels used for selecting printer parameters in accordance with the present invention.

As illustrated in FIG. 3, an exemplary series of label 50*a–d* separable by perforation lines 54 each include bar code symbols 52 and a text region 56. The text region 56 may be identified by the inclusion of the word "TEST" followed by a listing of specific parameter values. For example, label 50*a* lists a sensitivity number of 100; label 50*b* lists a sensitivity number of 120; label 50*c* lists a sensitivity number of 130; and, label 50*b* lists a sensitivity number of 200. The text region 56 may also list the parameter values for darkness and print speed in a similar manner, though it should be appreciated that for comparison purposes only one of the three parameters should be varied in the series while the other two remain constant. Though FIG. 3 illustrates a series of labels 50*a–d* comprising four labels, it should be apparent that any number of labels could be printed in the series depending on the total number of possible parameter choices.

At step 108, the operator evaluates the print quality of the series of labels. This evaluation may consist of a subjective visual inspection of the labels, particularly the text region 56, to identify one that looks best. In addition, the operator may attempt to scan the various bar codes 52 using a conventional bar code scanning device, such as a bar code verifier, to provide a more objective test of the print quality. As can be appreciated, the series of labels will include some that appear to be printed too lightly, and others that appear to be printed too darkly. Based on this subjective and objective evaluation, the operator selects a label having the best print quality which has a specified sensitivity number at step 109, and enters the selected sensitivity number at step 110. Thereafter, printing operations commence at step 111.

Having thus described a preferred embodiment of the method and apparatus for selecting printer parameters for different types of print media, it should be apparent to those skilled in the art that certain advantages have been achieved. It should also be appreciated that various modifications, adaptations, and alternative embodiments thereof may be made within the scope and spirit of the present invention. The invention is further defined by the following claims.

What is claimed is:

1. In a printer having a print region defined by a thermal print head and a rotatable platen adapted to draw a print media therebetween, a method for calibrating the printer comprises the steps of:

identifying a type of print media which is selected for use on said printer, wherein said selected type of print media has unknown printer parameter values;

printing a series of test labels onto said selected type of print media using a parameter of said printer having a unique value for each individual one of said test labels of said series with identifying information of said unique parameter value being printed thereon;

after printing said series of test labels, inspecting said series of test labels to select one of said test labels of said series having a desired level of image quality; and specifying said unique parameter value of said selected one of said test labels for further operation of said printer with said selected type of print media.

2. The method of claim 1, wherein said step of identifying a type of print media further comprises the step of identifying whether said print media is of a direct thermal type or a thermal transfer type.

3. The method of claim 1, wherein said step of printing a series of test labels further comprises the step of using a unique sensitivity value for each individual one of said test labels of said series.

4. The method of claim 1, wherein said step of printing a series of test labels further comprises the step of using a unique darkness value for each individual one of said test labels of said series.

5. The method of claim 1, wherein said step of printing a series of test labels further comprises the step of using a unique print speed value for each individual one of said test labels of said series.

6. An apparatus for calibrating a printer comprises:

means for printing a series of test labels onto a selected type of print media using a parameter of said printer having a unique value for each individual one of said test labels of said series, each said individual one of said test labels being printed with identifying information comprising said unique parameter value; and means for specifying said unique parameter value of a selected one of said test labels having desirable image quality for further operation of said printer with said selected type of print media.

7. The apparatus of claim 6, wherein said selected type of print media further comprises a direct thermal type.

8. The apparatus of claim 6, wherein said selected type of print media further comprises a thermal transfer type.

9. The apparatus of claim 6, wherein said parameter of said printer further comprises sensitivity.

10. The apparatus of claim 6, wherein said parameter of said printer further comprises darkness.

11. The apparatus of claim 6, wherein said parameter of said printer further comprises print speed.

12. A method for calibrating a printer for a selected print media having unknown print parameter values, comprising the steps of:

printing a plurality of test labels onto said selected print media using a unique parameter value for each respective one of said plurality of test labels, each said respective one of said plurality of test labels being printed with information identifying said unique parameter value;

after printing said plurality of test labels, selecting one of said plurality of test labels having a desired level of image quality; and specifying said unique parameter value of said selected one of said test labels for further operation of said printer with said selected print media.

13. The method of claim 12, further comprising the step of identifying a type of print media which is selected for use on said printer.

14. The method of claim 13, wherein said step of identifying a type of print media further comprises the step of identifying whether said print media is of a direct thermal type or a thermal transfer type.

15. The method of claim 12, wherein said step of printing a plurality of test labels further comprises the step of using a unique sensitivity value for each said respective one of said plurality of test labels.

16. The method of claim 12, wherein said step of printing a plurality of test labels further comprises the step of using a unique darkness value for each said respective one of said plurality of test labels.

17. The method of claim 12, wherein said step of printing a plurality of test labels further comprises the step of using a unique print speed value for each said respective one of said plurality of test labels.

18. In a printer having a print region defined by a thermal print head and a rotatable platen adapted to draw a print media therebetween, a printer control apparatus comprises:

a central processor adapted to control operation of said print head and said platen in response to selected parameter values; and a memory coupled to said central processor and comprising a stored program executable by a user to permit identification of said selected parameter values for a desired print media having unknown parameter values, said stored program causing said printer to print a plurality of test labels onto said print media using a unique parameter value for each respective one of said plurality of test labels, each said individual one of said test labels being printed with human-readable information comprising said unique parameter value;

whereby said user can identify said unique parameter value of a selected one of said test labels having desirable image quality for further operation of said printer with said desired print media.

19. The printer control apparatus of claim 18, wherein said unique parameter value further comprises one of sensitivity, darkness, and print speed.

20. The printer control apparatus of claim 18, wherein said desired print media further comprises one of direct thermal type and thermal transfer type.

* * * * *